US005492573A

United States Patent [19]

Fukushima et al.

[11] Patent Number: 5,492,573

[45] Date of Patent: Feb. 20, 1996

[54] HIGH-STRENGTH STAINLESS STEEL FOR USE AS MATERIAL OF FUEL INJECTION NOZZLE OR NEEDLE FOR INTERNAL COMBUSTION ENGINE, FUEL INJECTION NOZZLE MADE OF THE STAINLESS STEEL

[75] Inventors: Katsuaki Fukushima, Shimane; Toshio Okuno, Yasugi; Masakazu Ito, Kasugai; Keizo Takeuchi, Handa; Toshiaki Terada, Okazaki, all of Japan

[73] Assignees: Hitachi Metals, Ltd., Tokyo; Nippondenso Co., Ltd., Kariya, both of Japan

[21] Appl. No.: 229,005

[22] Filed: Apr. 18, 1994

[30] Foreign Application Priority Data

Apr. 19, 1993 [JP] Japan ..... 5-115383

[51] Int. Cl.[6] ..... C22C 38/22

[52] U.S. Cl. ..... 148/326; 148/325; 148/334

[58] Field of Search ..... 148/326, 325, 148/334; 420/67

[56] References Cited

U.S. PATENT DOCUMENTS

| | | | |
|---|---|---|---|
| 3,044,872 | 7/1962 | Hayes et al. . | |
| 4,634,573 | 1/1987 | Yanagiya et al. | 420/127 |
| 5,279,688 | 1/1994 | Isokawa et al. | 148/330 |
| 5,362,337 | 11/1994 | Kosa | 148/325 |
| 5,370,750 | 12/1994 | Novotry et al. | 148/325 |

FOREIGN PATENT DOCUMENTS

| | | | |
|---|---|---|---|
| 56-98453 | 8/1981 | Japan | 148/325 |
| 358025418 | 2/1983 | Japan | 148/325 |
| 62-156255 | 7/1987 | Japan . | |
| 62-196356 | 8/1987 | Japan . | |
| 64-21035 | 1/1989 | Japan . | |
| 3-20449 | 1/1991 | Japan . | |
| 3-36236 | 2/1991 | Japan . | |
| 3-226548 | 10/1991 | Japan . | |

*Primary Examiner*—Deborah Yee
*Attorney, Agent, or Firm*—Staas & Halsey

[57] ABSTRACT

A high-strength stainless steel for use as a material of a fuel injection nozzle or a fuel injection needle of an internal combustion engine. The stainless steel is an as annealed martensitic stainless steel which exhibits a hardness not less than HRC 58 after quenching and tempering heat-treatment. The limit swaging ratio of said as annealed martensitic stainless steel is not less than 75%. The hardness of said as annealed martensitic stainless steel is not higher than HB 157. Preferably, the number of carbides having sizes of 0.2 μm or less occupies not more than 50% of the total carbides, and wherein the limit swaging ratio of said as annealed martensitic stainless steel is not less than 75% or the hardness of said as annealed martensitic stainless steel is not higher than HB 157. Preferably, the stainless steel has a chemical composition containing, by weight: 0.4 to 0.6% of C; not more than 0.5% of Si; not more than 0.5% of Mn; 8.0 to 13.0% of Cr; 0.1 to 2.0% of one or both of W and Mo in terms of W/2+Mo; one or both of 0.05 to 1.0% of one or both of Nb and V in terms of Nb/2+ V, and 0.2 to 2.0% of Co; and the balance substantially Fe and incidental impurities.

30 Claims, 3 Drawing Sheets

( x 100 )

(x4000)

(x4000)

(x 4000)

(x 100)

HIGH-STRENGTH STAINLESS STEEL FOR USE AS MATERIAL OF FUEL INJECTION NOZZLE OR NEEDLE FOR INTERNAL COMBUSTION ENGINE, FUEL INJECTION NOZZLE MADE OF THE STAINLESS STEEL

BACKGROUND OF THE INVENTION

Field of the Invention

The present invention relates to a material of a fuel injection nozzle or a fuel injection needle for an internal combustion engine, and also to a fuel injection nozzle or needle produced from the material, as well as to a method of producing the fuel injection nozzle or needle by forging.

Experiences show that the materials of the fuel injection nozzle or needle should exhibit, after the heat treatment, a hardness of not less than HRC 57 or equivalent, as well as a corrosion resistance equivalent to that of JIS SUS 440C.

Presently used materials such as JIS SUS 420 J2, SUS 440B and SUS 440C cannot simultaneously satisfy both requirements for high corrosion resistance and high forging property which is necessary when the fuel injection nozzle or needle is fabricated by cold or warm forging. More specifically, JIS SUS 420 J2, which has a comparatively high forging property, inconveniently exhibits inferior wear resistance due to the fact that the hardness is reduced as a result of quenching and tempering heat treatment, whereas, JIS SUS 440B and JIS SUS 440C, which exhibit high level of hardness after the heat treatment, fail to provide required forging property.

SUMMARY OF THE INVENTION

An object of the present invention is to provide a material of a fuel injection nozzle or needle of an internal combustion engine which exhibits anti-rust property equivalent to that of SUS 440C, as well as hardness of HRC 57 or higher, preferably HRC 58 or higher, and which has forging property suitable for forming the fuel injection nozzle or the needle by forging, a fuel injection nozzle produced from such a material, and a method of producing such a fuel injection nozzle.

A test result showed that the forging property suitable for the production of fuel injection nozzle should be equivalent to that of machine structural steel, more specifically 75% or greater in terms of limit swaging ratio as specified by "Metallic Material Cold Swaging Testing Method (Tentative Standards)" shown in PLASTICITY AND WORKING, Vol 22 No. 241 pp 139–144. Incidentally, this value (75%) of the limit swaging ratio corresponds to the values of limit swaging ratio of as annealed low-alloy steels such as JIS SCr 420, SCr 440 or the like from which other parts are produced by cold forging. It is rather difficult to achieve this value with JIS SUS 410 and more difficult with high-strength martensitic stainless steel which exhibits hardness of HRC 57 or greater after heat treatment. It is almost impossible to obtain this value with high-strength martensitic steel which exhibits hardness of HRC 58 or greater.

The testing method for measuring the limit swaging ratio is as follows. A test piece of Type 1-A, which has a simple cylindrical form of an outside diameter dO and a length $h_0=1.5d_0$ and which has been machined at its outer peripheral surface and both axial end surfaces, was compressed at its both axial end surfaces by means of a press, and the swaging ratio at which cracking (0.5 mm long) is generated is determined as a value $\epsilon hc=(h_0-hc)\times 100/h_0$, where $h_0$ is a length before the testing and hc is a height as measured when the cracking has occurred. Usually, this test is conducted on n test pieces (n=5 or greater) and the swaging ratio at which n/2 test pieces exhibited cracking, i.e. cracking ratio being 50%, is determined as the limit swaging ratio.

Production by forging of a fuel injection nozzle of an internal combustion engine has a critical feature that the deep bore of the injection nozzle is formed by forging. This provides a remarkable improvement in the yield, as well as remarkable reduction in the number of steps of the production process, as well as shortening of the process time. FIG. 1A shows a final product of a tip portion of an injection nozzle, while FIG. 1B is a sectional view of a blank which has been formed by forging. In FIG. 1A, the two-dot chain line shows the outer configuration of blank from which the final product as hatched in FIG. 1A is to be formed by cutting by means of an automatic lathe. It will be easily understood that the production by forging, in which a blank as shown in FIG. 1B closely approximating the final shape is obtained, provides remarkable improvement in yield, as well as reduction in machining cost, as compared with the case of FIG. 1A which requires considerably large amount of cutting.

In order to improve forging property of high-strength martensitic stainless steel, the present inventors have attended to the form of carbides in this type of steel of as-annealed state, and conducted experiments by using various annealing methods to seek for the relationship between the limit swaging ratio and the form of the carbides. As a result, the present inventors have found that the limit swaging ratio can be improved when the amount of fine carbides is reduced. More specifically, the inventors have discovered that by controlling the size and grain size distribution of carbides through adopting suitable annealing conditions, it is possible to further reduce hardness in as-annealed state than ever and, hence, to improve the limit swaging ratio, and that a material having hardness and limit swaging ratio which could never be obtained conventionally becomes available by controlling the grain sizes and the rain size distribution of carbides to fall within ranges which can be obtained without difficulty. The inventors also have confirmed that, by using this material, a fuel injection nozzle of an internal combustion engine can be produced by cold forging using backward extrusion method.

According to a first aspect of the present invention, there is provided a high-strength stainless steel for use as a material of a fuel injection nozzle or a fuel injection needle of an internal combustion engine, the stainless steel being an as annealed martensitic stainless steel which exhibits a hardness not less than HRC 58 after quenching and tempering heat-treatment, wherein the limit swaging ratio of said as annealed martensitic stainless steel is not less than 75% which could never be achieved by conventional technique.

According to a second aspect of the present invention, there is provided a high-strength stainless steel for use as a material of a fuel injection nozzle or a fuel injection needle of an internal combustion engine, said stainless steel being an as annealed martensitic stainless steel which exhibits a hardness not less than HRC 57 after quenching and tempering heat-treatment, wherein the hardness of said as annealed martensitic stainless steel is not higher than HB 157 which could never be achieved by known techniques.

According to a third aspect of the present invention, there is provided a high-strength stainless steel for use as a material of a fuel injection nozzle or a fuel injection needle of an internal combustion engine, the stainless steel being an as annealed martensitic stainless steel which exhibits a hardness not less than HRC 57 often quenching and tempering heat-treatment, wherein the number of carbides having sizes of 0.2 μm or less occupies not more than 50% of the total carbides, and wherein the limit swaging ratio of said as annealed martensitic stainless steel is not less than 75% or the hardness of said as annealed martensitic stainless steel is not higher than HB 157.

According to a fourth aspect of the present invention, there is provided a high-strength stainless steel for use as a material of a fuel injection nozzle or a fuel injection needle of an internal combustion engine, the stainless steel having a specific chemical composition; wherein the number of carbides having sizes of 0.2 μm or less occupies not more than 50% of the total carbides.

According to a fifth aspect of the present invention, there is provided a fuel injection nozzle for an internal combustion engine, characterized by being formed by forging such that the fiber flow at the corner between the inner side wall surface and the inner bottom surface of the deep bore of said nozzle follow the directions of said inner side wall surface and inner bottom surface.

According to a sixth aspect of the present invention, there is provided a process for forming a fuel injection nozzle for an internal combustion engine, comprising the steps of: preparing a martensitic stainless steel of any one of the first to fourth aspects as the material, forming a deep bore in a blank of the material by forging of backward extrusion method; and effecting a quenching and tempering heat treatment so as to obtain a hardness not less than HRC 57.

In the first, second, third, fifth and sixth aspects of the invention, the martensitic stainless steel preferably but not exclusively has a chemical composition containing, by weight: 0.4 to 0.6% of C; not more than 0.5% of Si; not more than 0.5% of Mn; 8.0 to 13.0% of Cr; 0.1 to 2.0% of one or both of W and Mo in terms of (W/2+Mo); one or both of 0.05 to 1.0% of one or both of Nb and V in terms of (Nb/2+V), and 0.2 to 2.0% of Co; and the balance substantially Fe and incidental impurities.

This chemical composition also may be used as the specific chemical composition used in the fourth aspect of the invention.

DETAILED DESCRIPTION OF THE INVENTION

Figure 1A:
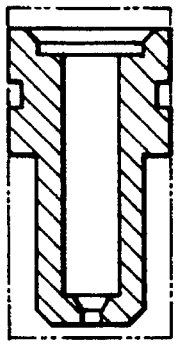
FIG. 1A is an illustration of a blank of a fuel injection nozzle formed by conventional technique such as cutting.
Figure 1B:
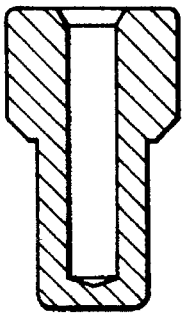
FIG. 1B is an illustration of a blank of a fuel injection nozzle formed by forging.
Figure 2A:
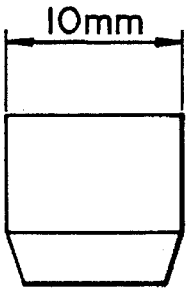
FIG. 2A is an illustration of a test piece to be subjected to test forging.

According to the invention, a method in which a deep bore is formed by backwardly extruding a test piece shown in FIG. 2A was used as a method for evaluation of the forging property, together with the measurement of the limit swaging ratio mentioned before. As will be detailed later, many tests were conducted mainly at the limit swaging ratio, and backward extrusion forging was conducted on several test samples to confirm forging property.

As stated before, a material having fine carbides of 0.2 μm or smaller occupying not more than 50% of the total carbide can effectively used as the material for producing a fuel injection nozzle of an internal combustion engine. Actually, however, it is extremely difficult to reduce the proportion of fine carbides of 0.2 μm or smaller down to a value below 50% of total carbide in high-strength martensitic steel, through ordinary softening annealing heat treatment. The present inventors, through studies and experiments, have found that this value of proportion of fine carbides can be attained either by the following annealing treatment method A or B.

Treating method A:

To effect very slow annealing cooling from a temperature not lower than AC1 transformation point Treating method B:

To cause precipitation and growth of fine carbides dissolved after a hot working.

It is to be noted, however, the treatment A and the treatment B are not indispensable for the constitution of the invention because there may be other method or methods which will realize such a grain size distribution of carbides that fine carbides of 0.2 μm or finer occupies not more than 50% of the total carbides.

Figure 3A:
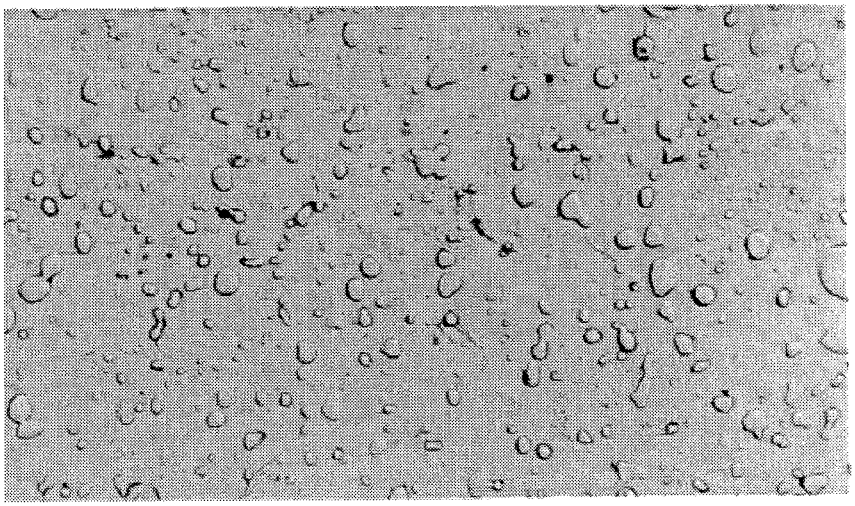
FIG. 3A is an electron-microscopic micro-structure photograph (magnification 4000) of steel in accordance with the present invention having a composition of 0.55C-0.1Si-0.2Mn-12Cr-0.3Mo-0.1V as annealed in accordance with an ordinary annealing method consisting of slow cooling at 15° C./hour from 860° C. to 600° C., the micro-structure having carbides of 0.2 μm or less which occupies about 80% of the total carbides.
Figure 3B:
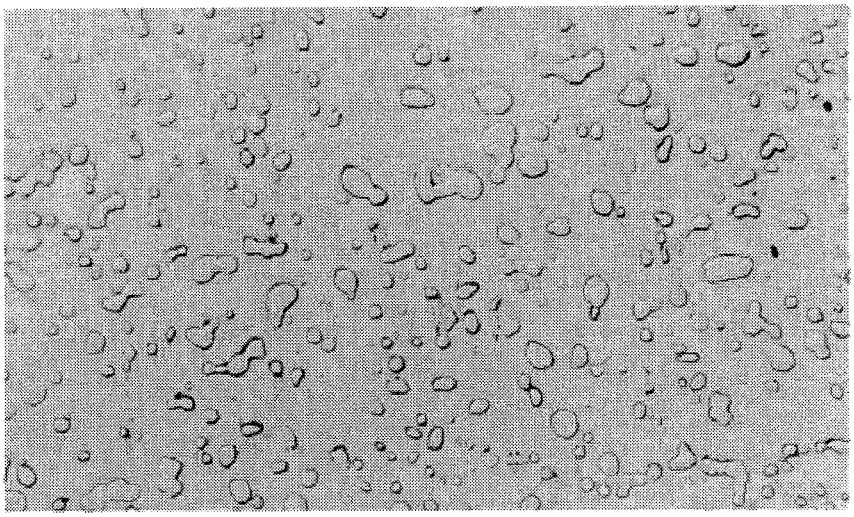
FIG. 3B is an electron-microscopic micro-structure photograph (magnification 4000) of the above-mentioned steel as annealed by a treating method A which consists of a very slow cooling from a temperature not lower than AC1 transformation point, the micro-structure having carbides of 0.2 μm or less which occupies about 30% of the total carbides.
Figure 3C:
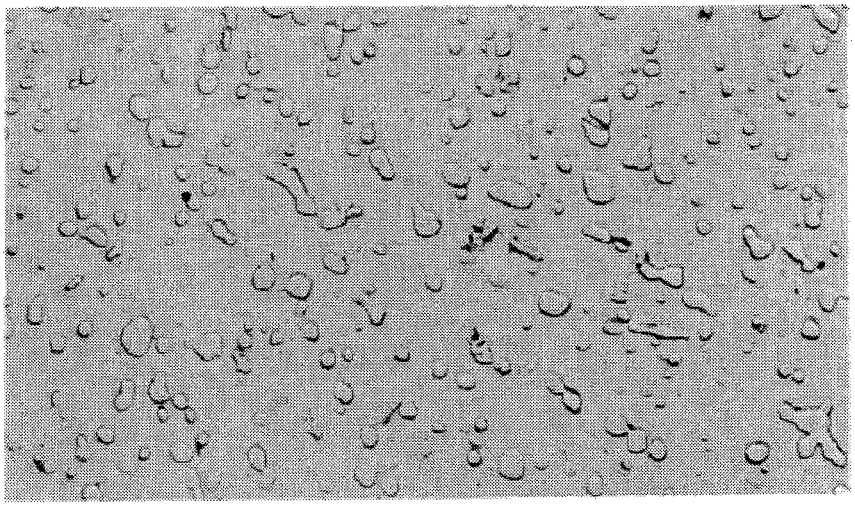
FIG. 3C is an electron-microscopic micro-structure photograph (magnification 4000) of the above-mentioned steel as annealed by a treating method B which consists in precipitating and growing fine carbides dissolved after a hot working, the micro-structure having carbides of 0.2 μm or less which occupies about 40% of the total carbide.

FIGS. 3A, 3B and 3C show micro-structures as observed through an electron microscope (magnification 4000) of a steel having the following composition, as annealed by an ordinary annealing treating method, by the treatment A and by the treatment B, respectively.

More specifically, FIG. 3A is an electron-microscopic micro-structure photograph of steel having a composition of 0.55C-0.1Si-0.2Mn-12Cr-0.3Mo-0.1V as annealed in accordance with an ordinary annealing method consisting of slow cooling at 15° C./hour from 860° C. to 600° C. In this case, the micro-structure had carbides of 0.2 μm or less occupying about 80% of the total carbides, and exhibited a limit swaging ratio of 70%. FIG. 3B is an electron-microscopic micro-structure photograph of the above-mentioned steel as annealed by the treating method A mentioned above. In this case, the micro-structure having carbides of 0.2 μm or less occupied about 30% of the total carbides, and the limit swaging ratio was 79%, thus showing remarkable improvement in the limit swaging ratio.

FIG. 3C is an electron-microscopic micro-structure photograph of the above-mentioned steel as annealed by the treating method B mentioned above. In this case, the microstructure had carbides of 0.2 μm or less which occupied about 40% of the total carbides and limit swaging ratio of 78%. Thus, the steels treated in accordance with the treating methods A and B exhibited remarkable improvement in the limit swaging ratio as compared with the material treated by the conventional method.

It is considered that carbides in a steel impedes plastic working, i.e., slip deformation, of the steel so as to enhance the resistance to deformation thus increasing the hardness, while increasing the risk of generation of cracks. This might be attributed to the following reasons. In general, slip and movement of dislocation in crystal grains is closely related to surface areas of carbides. More specifically, the greater the proportion of fine carbides, the greater the total surface area and, hence, the resistance to deformation, for a given content (vol %) of the carbides. According to the third and fourth aspects of the present invention, the number of the carbides of sizes no greater than 0.2 μm is determined to be not more than 50% of the total carbides. The above-mentioned values of the carbide grain size and the proportion of the fine carbides have been determined as controllable values which have been confirmed through experimental productions by several heat-treating methods. The threshold grain size for fineness of the carbides is determined to be 0.2 μm in diameter.

The limitation of the fine carbides of 0.2 μm or finer being not more than 50% is an essential requirement for enabling production of a fuel injection nozzle without suffering from any crack.

By reducing the proportion of the fine carbides in the total carbides as stated above, it is possible to improve the limit swaging ratio and to reduce the hardness, making it possible to produce the nozzle by cold forging. It was also confirmed that the production of a fuel injection nozzle from the material of the type described essentially requires that the limit swaging ratio is 75% or higher and that the hardness in as-annealed state is HB 157 or less. These limit values therefore are used as the critical limit values in the present invention.

In other words, the known techniques could not provide any martensitic stainless steel which would simultaneously meet the requirement of post-heat-treatment hardness being HRC 57 or higher and as-annealed hardness being HB 157 or lower, nor any martensitic stainless steel which would simultaneously meet the condition of post-heat-treatment hardness being HRC 58 or higher and limit swaging ratio being 75% or greater.

As stated before, the limit swaging ratio value of 75% is substantially equivalent to those exhibited by low-alloy steels which are ordinarily used for forming other mechanical parts by cold forging, such as SCr 420, SCr 440 and so forth.

In order that the material for fuel injection nozzle has required level of cold forging property, it is important to minimize the contents of alloy elements, as well as unavoidable impurities, from the steel composition. At the same time, however, addition of minimal alloy elements such as C, Cr, Mo and so forth is necessary in order to simultaneously achieve anti-rust property equivalent to that of JIS SUS 440C and hardness of HRC 57 or greater after heat treatment. In regard to the heat-treating conditions, when a vacuum furnace is used as a quenching furnace, the material should have such quenching property that the material is satisfactorily quenched by 10-minute half-temperature cooling, i.e., by a quenching treatment in which the temperature is lowered in 10 minutes from the quenching temperature to a temperature which is ½ the quenching temperature. Addition of alloy elements such as Mn, Mo, W and V also is necessary to achieve such a level of quenching property. The fuel injection nozzle and needle of an internal combustion engine are used at comparatively low temperature. The tempering therefore may be conducted at 150° to 200° C. To these requirements, the composition as defined in the fourth aspect of the invention is preferably used in the first to third aspects, as well as the fifth and sixth aspects of the invention.

A description will now be given of the reasons of limitations of contents (percents by weight) of elements of the high-strength martensitic steel used as the material of a fuel injection nozzle or needle used in the present invention.

Carbon is an element which is essentially contained to provide required level of strength. More specifically, when quenching is effected, carbon changes most part of the matrix phase into martensitic structure and is dissolved in the martensitic structure so as to enhance the strength. In order that the hardness of HRC 57 or higher or HCR 58 or higher in the heat-treated state is attained to meet the requirements of the invention, the carbon content should be at least 0.4%. Conversely, carbon content exceeding 0.6% causes an increase in the carbide to make it difficult to attain the limit swaging ratio of 75%. The carbon content is therefore determined to be from 0.4 to 0.6%.

Si is an element which is essentially used as a deoxidization element of steel. Any excessive Si, however, is dissolved in the matrix so as to impair the cold-workability. The Si content therefore should be as small as possible. For these reasons, the content of Si is limited to be 0.5% or less.

Mn also is added in the steel melt-forming process as a deoxidization element similarly to Si. This element also provides an effect to improve quenching property. This element, however, significantly impairs the cold-workability and, therefore, its content should be as small as possible. The content of this element is therefore limited to be 0.5 wt % or less.

Cr is an important element as it forms an oxide film on the material surface so as to improve corrosion resistance and anti-rust property. In view of the requirement for high anti-rust property at lets equivalent to that of conventionally used JIS SUS 440C, Cr content is determined in relation to the C content, preferably to be 8.0% or grater which provides Cr % in the matrix equivalent to that in JIS SUS 440C. A too large Cr content, however, impedes reduction in the hardness during annealing, thus impairing cold workability. The Cr content therefore should not exceed 13%.

Both W and Mo effectively serve to improve quenching property. These elements, when the material is heat-treated, are dissolved in the matrix so as to enhance the corrosion resistance. These elements are particularly necessary when the steel of the invention is heat-treated in a vacuum furnace, in order to enhance the quenching property of the product. Too large contents of W and Mo adversely affect the cold workability. It is therefore preferred that one or both of W and Mo are added by an amount of 0.1 to 2% in terms of (W/2+Mo).

V and Nb are elements which prevent coarsening of the Crystal grains during quench heating, so a to improve mechanical properties. When the contents of these elements are too large, however, hard carbides are formed to adversely affect the cold working. One or both of V and Nb, therefore, added as required by an amount of 0.05 to 1.0% in terms of (Nb/2+V).

Co is an element which effectively improves the corrosion resistance while reducing, when used as the material of a fuel injection nozzle, the coefficient friction between the nozzle seat and the mating needle. This element, however, tends to impair hardness after annealing so as to impair cold-workability. The content of this element, therefore, is determined to range from 0.2 to 2.0%.

Contents of impurities such as P and S also should be minimized in the steel of the invention.

The forging of the blank material for forming deep bore by backward extrusion employs a punch. The punch tends to be broken due to buckling as a result of generation of high buckling stress therein. In addition, the out peripheral edge of the end of the punch tends to be worn due to friction with active generated surface of the work which is being punched.

In particular, in the production of a fuel injection nozzle in accordance with the present invention, the material used exhibits deformation resistance which is much greater than that exhibited by SCr 420, SCr 440 or the like exhibited before, although the cracking tendency is suppressed thanks to the limit swaging ratio being 75% or greater. Consequently, the outer peripheral edge of the punch end experiences heavy wear during the forging. The present inventors tested various punch materials and found that cemented carbide alloys are suitably used as the punch material due to excellency in wear resistance.

Examples

Examples of the embodiments of the present invention will be described.

Table 1 shows the chemical compositions of martensitic stainless steels used in a test. Samples A to J have compositions which meet the requirements of the fourth aspect of the invention, while Samples P to W do not fall within the ranges specified by the fourth aspects of the invention. Samples P to W therefore will be referred to as "Comparative Steel". More specifically, the comparative steel P corresponds to JIS 420 J2, R corresponds to JIS SUS 440A, S corresponds to JIS SUS 440B, T corresponds to JIS SUS 440C and W corresponds to SCr 440.

Each sample steel was hot-worked to reduce the diameter to 14 mm. Test pieces of each such hot-work sample were subjected to an ordinary heat treatment consisting of slow cooling from 860° C. to 600° C. at 15° C./hours and to the aforementioned treatment B, respectively. The treatment A mentioned before also was conducted, besides the treatment B, to the sample J. In Table 2 which will be mentioned later, the test piece of Sample J treated by the treatment B is shown as J1, while the test piece treated by the treatment A is indicated by J2, for the purpose of discrimination. Each test piece was subjected to measurement of Brinell hardness (HB), as well as to measurement of limit swaging ratio. In addition, ratios or proportions of fine carbides of 0.2 μm or finer to total carbides were measured on selected test pieces. Among the test pieces which have undergone the treatment B or A, test pieces of samples A to J2 and P to V were subjected to a treatment having the steps of 45-minute heating at 1050° C., quenching by blowing of 3 Bar nitrogen gas (this corresponds to 10-minute half temperature quenching) and a subsequent sub-zero treatment consisting in holding at −78° C. for two hours followed by tempering for two hours at 180° C. Test piece of the sample W was subjected, after the treatment B, to a heat treatment consisting of 30-minute heating at 850° C. followed by oil quenching and a subsequent 2-hour annealing at 560° C. Hardness levels (HRC) of the test pieces thus treated were then measured.

The measurement of the limit swaging ratio was conducted by using test pieces of 6 mm diameter and 9 mm long on a 50-ton Amsler testing machine, increasing the swaging ratio in a stepped manner at a pitch of 2% while removing load and visually checking for cracking after each increase in the swaging ratio. More specifically, a preparatory test as conducted to roughly predict the cracking strain level, and the strain was increased stepwise by 2% each time starting from a value which is 15% smaller than that of the predicted cracking strain level. In order to constrain the upper and lower faces of the test piece, the upper and lower dies were serrated in a manner like growth rings of trees.

The ratio of the number of fine carbides of 0.2 μm or finer to the total carbide was determined through analysis of image obtained by an electron microscopic photograph at magnification 10000.

TABLE 1

| | Chemical compositions (wt %) Samples | | | | | | | | | |
|---|---|---|---|---|---|---|---|---|---|---|
| | C | Si | Mn | Cr | W | Mo | V | Nb | Co | Fe |
| Invention Steel | | | | | | | | | | |
| A | 0.58 | 0.12 | 0.21 | 8.21 | 0 | 1.79 | 0 | 0 | 0 | Bal |
| B | 0.42 | 0.12 | 0.24 | 8.25 | 0 | 0.93 | 0.15 | 0.05 | 1.84 | " |
| C | 0.54 | 0.11 | 0.27 | 9.21 | 0.15 | 0.44 | 0.10 | 0 | 0 | " |
| D | 0.50 | 0.08 | 0.24 | 9.20 | 0 | 0.25 | 0.12 | 0 | 0 | " |
| E | 0.54 | 0.20 | 0.21 | 11.45 | 0.10 | 0.22 | 0 | 0 | 0 | " |
| F | 0.47 | 0.45 | 0.17 | 11.47 | 0 | 0.20 | 0.09 | 0.06 | 0 | " |
| G | 0.49 | 0.11 | 0.22 | 11.18 | 0.34 | 0 | 0 | 0 | 0 | " |
| H | 0.55 | 0.21 | 0.20 | 12.77 | 0 | 0.26 | 0.09 | 0 | 0 | " |
| I | 0.42 | 0.27 | 0.47 | 8.71 | 0.26 | 1.69 | 0 | 1.27 | 0 | " |
| J | 0.55 | 0.11 | 0.21 | 9.55 | 3.46 | 0.02 | 0.92 | 0 | 0 | " |
| Comparative Steel | | | | | | | | | | |
| P | 0.35 | 0.57 | 0.96 | 12.80 | 0 | 0 | 0 | 0 | 0 | Bal |
| Q | 0.67 | 0.27 | 0.25 | 12.54 | 0 | 0.21 | 0.10 | 0 | 0 | " |
| R | 0.69 | 0.87 | 0.54 | 16.89 | 0 | 0.10 | 0 | 0 | 0 | " |
| S | 0.81 | 0.75 | 0.51 | 17.10 | 0 | 0.10 | 0 | 0 | 0 | " |
| T | 0.99 | 0.92 | 0.66 | 16.73 | 0 | 0.12 | 0 | 0 | 0 | " |

TABLE 1-continued

| | Chemical compositions (wt %) Samples | | | | | | | | | |
|---|---|---|---|---|---|---|---|---|---|---|
| | C | Si | Mn | Cr | W | Mo | V | Nb | Co | Fe |
| U | 0.55 | 0.25 | 0.30 | 8.26 | 0 | 2.32 | 0.17 | 0 | 0 | " |
| V | 0.53 | 0.62 | 0.25 | 9.76 | 0 | 0.23 | 0.10 | 0 | 0 | " |
| W | 0.41 | 0.27 | 0.78 | 1.10 | 0 | 0 | 0 | 0 | 0 | " |

*1: Steels A to V are martensitic stainless steels.
*2: Steel W is a mechanical structural alloy steel (SCr 440).

TABLE 2

| | After annealing | | | | After treatment B | | | Hardness | Anit-rust |
|---|---|---|---|---|---|---|---|---|---|
| | Annealing method | Hardness (HB) | Limit swaging ratio (%) | Carbides of 0.2 μm or finer (%) | Hardness (HB) | Limit swaging ratio (%) | Carbides of 0.2 μm or finer (%) | after heat treatment (HRC)** | property after heat treatment*** |
| Invention Steel | | | | | | | | | |
| A | Slow cooling from 860° C. | 162 | 66 | 87 | 153 (9) | 78 (12) | 31 | 62.3 | B |
| B | Slow cooling from 860° C. | 162 | 66 | | 155 (7) | 77 (11) | | 60.4 | B |
| C | Slow cooling from 860° C. | 160 | 70 | | 152 (8) | 78 (8) | | 61.7 | B |
| D | Slow cooling from 860° C. | 158 | 73 | 85 | 148 (10) | M80 (7+) | 20 | 59.6 | B |
| E | Slow cooling from 860° C. | 162 | 64 | | 157 (5) | 75 (11) | | 58.9 | B |
| F | Slow cooling from 860° C. | 164 | 63 | 70 | 156 (8) | 77 (14) | 25 | 58.1 | B |
| G | Slow cooling from 860° C. | 162 | 68 | | 149 (13) | 79 (11) | | 58.6 | B |
| H | Slow cooling from 860° C. | 165 | 61 | | 156 (9) | 76 (5) | | 58.7 | B |
| I | Slow cooling from 860° C. | 159 | 72 | 90 | 149 (10) | M80 (8+) | 47 | 60.2 | B |
| J1 | Slow cooling from 860° C. | 160 | 71 | | 150 (10) | 78 (7) | | 62.0 | B |
| Comparative Steel | | | | | | | | | |
| J2 | | | | | Treatment A | | | | |
| | | | | | 152 (8) | 76 (5) | | 62.0 | B |
| P | Slow cooling from 860° C. | 161 | 72 | 71 | 153 (8) | 77 (5) | 43 | 53.5 | A |
| Q | Slow cooling from 860° C. | 170 | 56 | | 160 (10) | 71 (15) | | 60.7 | C |
| R | Slow cooling from 860° C. | 177 | 47 | | 167 (10) | 60 (13) | | 57.2 | A |
| S | Slow cooling from 860° C. | 173 | 42 | 68 | 177 (−4) | 44 (2) | 47 | 60.0 | A |
| T | Slow cooling from 860° C. | 187 | 38 | | 183 (4) | 50 (12) | | 61.3 | B |
| U | Slow cooling from 860° C. | 169 | 60 | 82 | 160 (9) | 70 (10) | 35 | 61.9 | B |
| V | Slow cool- | 164 | 62 | | 160 (4) | 71 (9) | | 60.6 | B |

TABLE 2-continued

| | After annealing | | | | After treatment B | | | Hardness | Anit-rust |
|---|---|---|---|---|---|---|---|---|---|
| | Annealing method | Hardness (HB) | Limit swaging ratio (%) | Carbides of 0.2 μm or finer (%) | Hardness (HB) | Limit swaging ratio (%) | Carbides of 0.2 μm or finer (%) | after heat treatment (HRC)** | property after heat treatment*** |
| W | ing from 860° C. Slow cooling from 820° C. | 152 | 76 | 25 | 153 (−1) | 75 (−1) | 20 | 32.0 | D |

*M80: Not less than 80.

**Samples A to J1, J2 and P to V were subjected to a treatment consisting of 45-minute heating at 105° C., cooling by 3-Bar N2, 2-hour sub-zero treatment at −78° C. and 2-hour tempering at 180° C. Sample W was subjected to 30-minute heating at 850° C. followed by oil quenching and subsequent tempering at 560° C.

***Anti-rust Property: A 2-hour salt spray test in accordance with JIS Z2371 was conducted. Anti-rust property equivalent to that of JIS SUS 440C is indicated by B. Samples exhibiting better anti-rust property are marked by A. Marks C and D respectively indicate that the anti-rust property is inferior and much inferior than B, respectively.

The results of the test are shown in Table 2. In Table 2, values shown in parenthesis ( ) indicate Brinnel hardness values reduced by the treatment A or B or limit swaging ratio (%) improved by the treatment A or B. The following facts are understood from this Table.

Referring to the sample steels A, D, F and I of the invention and comparative sample steels P, S, U and W, the ratio of the fine carbides of 0.2 mm or finer to the total carbides exceeds 50%, except for the case of the comparative sample steel W, when conventional annealing method is applied. The value of this ratio, however, is reduced to 50% or less in all the sample steels of the invention and comparative sample steels when the annealing is conducted by the treatment B. This treatment also provides high limit swaging ratio of 75% or greater in all the sample steels of the invention and in comparative sample steels P and W. However, the requirement of limit swaging ratio being 75% or higher is not met by the comparative sample steel S due to too high carbon and high Cr content and by the comparative sample steel U due to too high Mo content. The sample steels of the invention and the comparative sample steels, when treated in accordance with the treatment B or A, exhibit softening by 5 to 13 and −4 to 10, by 8.8 and 5.0 in average, in terms of Brinell hardness,. All the sample steels in accordance with the invention treated by the treatment B or A achieved Brinnel hardness of HB 157 or less and limit swaging ratio values exceeding 75%.

The above-described superior effects may be attributed to the fact that the precipitation of fine carbides of 0.2 μm or finer is reduced by the treatment A or B, so that the mean ferrite path is increased to correspondingly increase the plastic workability. Comparative sample steels other than W showed improvement in the limit swaging ratio as a result of the treatment B but the requirement of the limit swaging ratio being 75% or more is met only by P and W.

It is understood that all the sample steels of the invention exhibit HRC hardness of 58 or higher after the heat treatment. The comparative sample steel P exhibits a hardness of HB 157 or less as a result of the treatment B, so that the limit swaging ratio is increased to exceed 75%. The comparative sample steel P, however, exhibits low level of hardness after the heat treatment as in the case of the comparative sample steel W and, therefore, does not fall within the scope of the invention. Comparative sample steels other than P and W do not exhibits hardness levels of HB 157 or less even after the treatment B and the values of limit swaging ratio are not higher than 75%. The small values of limit swaging ratio of these comparative sample steels are attributed to chemical compositions.

As stated before, the comparative sample steel W is a material equivalent to the mechanical structural steel SCr 440. This material exhibits superior limit swaging ratio of 76% even when annealed in accordance with ordinary annealing method. No further improvement in the limit swaging ratio, however, is caused even when this material is treated in accordance with the treatment B.

Table 2 also shows the results of salt spray test conducted to examine anti-rusting properties. Anti-rust property equivalent to that of JIS SUS 440C is indicated by B. Samples exhibiting better anti-rust property are marked by A. Marks C and D respectively indicate that the anti-rust property is inferior and much inferior than B, respectively. All the sample steels meeting the condition of the invention showed anti-rust properties ranked at B, thus proving corrosion resistance equivalent to that of SUS 440C.

Figure 2B:
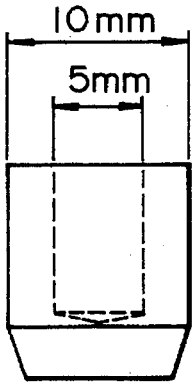
FIG. 2B is an illustration of the test piece after the test forging.

Table 3 shows the results of experimental production of injection nozzle by forging. Five test pieces were subjected to the test. Deep bore of injection nozzle as shown in FIG. 2B was formed by a single cold-forging action of a cemented carbide alloy. Evaluation was conducted in regard to cracking in the test pieces and also in terms of the punch surface pressure developed on the end surface of the punch during the forging. The test pieces were fabricated from the sample steel E of the invention treated by the treatment A, the same steel E treated by the treatment B, the same steel E treated by ordinary annealing method consisting in slow cooling from 860° C. and the comparative sample steel V treated by the treatment B.

As will be seen from table 3 showing the results of the experimental production, formation of deep bores by forging was successfully conducted without any cracking with the sample steel E of the invention treated by the treatment A or B. In contrast, fine cracks were found and high punch surface pressure were observed in the test piece of the steel E treated by the ordinary annealing method and the test pieces of the comparative sample steel B treated by the treatment V. Hopefully, the punch surface pressure should be maintained at a level not higher than 300 kgf/mm$^2$. The punch surface pressure an effectively reduced by the treatment A or B.

A similar deep-bore forging test also was conducted by using a punch made of a high-speed tool steel, on the sample steel E of the invention. As a result, it was confirmed that mass-production of fuel injection nozzle is possible using this type of punch, although a slight wear was observed on the peripheral edge of the punch.

Figure 4:
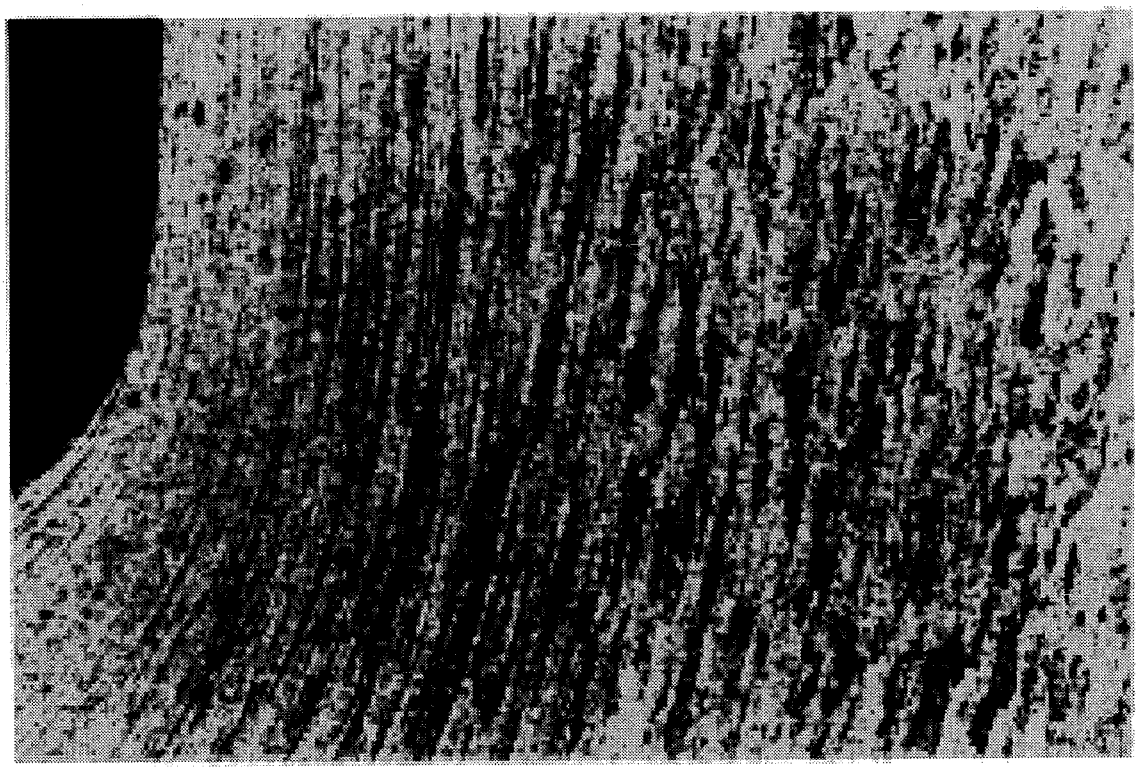
FIG. 4 is a metal microscopic micro-structure photograph showing the fiber flow at the corner between inner peripheral surface and inner bottom surface of a deep bore formed in accordance with the method of the invention.

FIG. 4 is a metallurgical microscopic photograph of micro-structure (magnification 100), showing the fiber flow in the corner region between the inner peripheral surface and the inner bottom surface of the cold-forged test piece of the sample steel E of the invention. It will be understood that the fiber flows to follow the inner peripheral surface and the inner bottom surface, respectively.

TABLE 3

| Material | Treatment | Punch surface pressure (kgf/mm$^2$) | Cracks |
|---|---|---|---|
| E | A | 290 | No cracking |
| E | B | 280 | No cracking |
| E | Conventional method | 310 | Fine cracking found in cross-section of corner of forged bore |
| V | B | 330 | Fine cracking found in cross-section of corner of forged bore |

As has been described, the present invention has clarified the characteristics required for the materials to be used for production by forging of a fuel injection nozzle for an internal combustion engine, while improving distribution of carbides in a high-strength stainless steel, thus providing a material having low hardness and high limit swaging ratio which could never be achieved by the known techniques.

Thus, the present invention contributes to reduction in the production cost of fuel-injection type engines which are expected to become more popular in the future. Although the invention has been described with specific reference to a fuel injection nozzle for an internal combustion engine, it will be clear that the invention also an be applied to a needle which is used n invention also an be applied to a needle which is used n combination with the injection nozzle.

What is claimed is:

1. A high-strength stainless steel for use as a material of construction for a fuel injection nozzle or a fuel injection needle of an internal combustion engine, said stainless steel being an as annealed martensitic steel containing, by weight, 0.4 to 0.6% of C; not more than 0.5% of Si; not more than 0.5% of Mn; 8.0 to 13.0% of Cr; 0.1 to 2.0% of one or both of W and Mo in terms of (W/2+Mo), and wherein said stainless steel contains particulate carbide materials including a first group of carbide particles having a particle size greater than 0.2 μm and a second group of carbide particles having a particle size which is smaller than the particle size of said first group of carbide particles, the number of particles in said first group of carbide particles being more than 50% of the total number of carbide particles in said steel, and wherein the limit swaging ratio of the as-annealed martensitic stainless steel is not less than 75%.

2. A high-strength steel as set forth in claim 1, containing one or both of Nb and V, and wherein the amount of Nb and V in the steel is defined in terms of the relationship $0.05\% \leqq (Nb/2+V) \leqq 1.0\%$.

3. A high-strength steel as set forth in claim 1, containing 0.05 to 1.0% of V.

4. A high-strength steel as set forth in claim 1, containing 0.1 to 2.0% of Nb.

5. A high-strength steel as set forth in claim 1, containing 0.2 to 2.0% of Co.

6. A high-strength steel as set forth in claim 2, containing 0.2 to 2.0% of Co.

7. A high-strength stainless steel for use as a material of construction for a fuel injection nozzle or a fuel injection needle of an internal combustion engine, said stainless steel being an as annealed martensitic steel containing, by weight, 0.4 to 0.6% of C; not more than 0.5% of Si; not more than 0.5% of Mn; 8.0 to 13.0% of Cr; 0.1 to 2.0% of one or both of W and Mo in terms of (W/2+Mo), and wherein said stainless steel contains particulate carbide materials including a first group of carbide particles having a particle size greater than 0.2 μm and a second group of carbide particles having a particle size which is smaller than the particle size of said first group of carbide particles, the number of particles in said first group of carbide particles being more than 50% of the total number of carbide particles in said steel, and wherein the hardness of said as annealed martensitic stainless steel is not higher than HB 157.

8. A high-strength steel as set forth in claim 7, containing one or both of Nb and V, and wherein the amount of Nb and V in the steel is defined in terms of the relationship $0.05\% \leqq (Nb/2+V) \leqq 1.0\%$.

9. A high-strength steel as set forth in claim 7, containing 0.05 to 1.0% of V.

10. A high-strength steel as set forth in claim 7, containing 0.1 to 2.0% of Nb.

11. A high-strength steel as set forth in claim 7, containing 0.2 to 2.0% of Co.

12. A high-strength steel as set forth in claim 8, containing 0.2 to 2.0% of Co.

13. A high-strength stainless steel for use as a material of construction for a fuel injection nozzle or a fuel injection needle of an internal combustion engine, said stainless steel being an as annealed martensitic steel containing, by weight, 0.4 to 0.6% of C; not more than 0.5% of Si; not more than 0.5% of Mn; 8.0 to 13.0% of Cr; 0.1 to 2.0% of one or both of W and Mo in terms of (W/2+Mo), and wherein said stainless steel contains particulate carbide materials including a first group of carbide particles having a particle size greater than 0.2 μm and a second group of carbide particles having a particle size which is smaller than the particle size of said first group of carbide particles, the number of particles in said first group of carbide particles being more than 50% of the total number of carbide particles in said steel, and wherein the hardness of said as annealed martensitic stainless steel is not higher than HB 157 and the limit swaging ratio of said as annealed martensitic stainless steel is not less than 75%.

14. A high-strength steel as set forth in claim 13, containing one or both of Nb and V, and wherein the amount of Nb and V in the steel is defined in terms of the relationship $0.05\% \leqq (Nb/2+V) \leqq 1.0\%$.

15. A high-strength steel as set forth in claim 13, containing 0.05 to 1.0% of V.

16. A high-strength steel as set forth in claim 13, containing 0.1 to 2.0% of Nb.

17. A high-strength steel as set forth in claim 13, containing 0.2 to 2.0% of Co.

18. A high-strength steel as set forth in claim 14, containing 0.2 to 2.0% of Co.

19. A fuel injection nozzle for an internal combustion engine formed by forging from a high-strength as-annealed martensitic stainless steel such that the fiber flow at the corner between the inner side wall surface and the inner bottom surface of the deep bore of the nozzle follows the directions of the inner side wall surface and the inner bottom surface, said steel containing, by weight, 0.4 to 0.6% of C; not more than 0.5% of Si; not more than 0.5% of Mn; 8.0 to 13.0% of Cr; 0.1 to 2.0% of one or both of W and Mo in terms of (W/2+Mo), said stainless steel having a hardness which is not less than HRC 57.

20. A fuel injection nozzle as set forth in claim 19, wherein said stainless steel contains one or both of Nb and V, and wherein the amount of Nb and V in the steel is defined in terms of the relationship 0.05%≦(Nb/2+V)≦1.0%.

21. A fuel injection nozzle as set forth in claim 19, wherein said stainless steel contains 0.05 to 1.0% of V.

22. A fuel injection nozzle as set forth in claim 19, wherein said stainless steel contains 0.1 to 2.0% of Nb.

23. A fuel injection nozzle as set forth in claim 19, wherein said stainless steel contains 0.2 to 2.0% of Co.

24. A fuel injection nozzle as set forth in claim 20, wherein said stainless steel contains 0.2 to 2.0% of Co.

25. A high-strength stainless steel for use as a material of construction for a fuel injection nozzle or a fuel injection needle of an internal combustion engine, said stainless steel containing, by weight, 0.4 to 0.6% of C; not more than 0.5% of Si; not more than 0.5% of Mn; 8.0 to 13.0% of Cr; 0.1 to 2.0% of one or both of W and Mo in terms of (W/2+Mo), and wherein said stainless steel contains particulate carbide materials including a first group of carbide particles having a particle size greater than 0.2 μm and a second group of carbide particles having a particle size which is smaller than the particle size of said first group of carbide particles, the number of said first group of carbide particles being more than 50% of the total number of carbide particles in said steel.

26. A high-strength steel as set forth in claim 25, containing one or both of Nb and V, and wherein the amount of Nb and V in the steel is defined in terms of the relationship 0.05%≦(Nb/2+V)≦1.0%.

27. A high-strength steel as set forth in claim 25, containing 0.05 to 1.0% of V.

28. A high-strength steel as set forth in claim 25, containing 0.1 to 2.0% of Nb.

29. A high-strength steel as set forth in claim 25, containing 0.2 to 2.0% of Co.

30. A high-strength steel as set forth in claim 26, containing 0.2 to 2.0% of Co.

* * * * *

UNITED STATES PATENT AND TRADEMARK OFFICE

CERTIFICATE OF CORRECTION

PATENT NO. : 5,492,573

DATED : February 20, 1996

INVENTOR(S) : KATSUAKI FUKUSHIMA et al.

It is certified that error appears in the above-indentified patent and that said Letters Patent is hereby corrected as shown below:

Title Page, section [56] under "U.S Patent Documents", line 5, delete "Novotry" and substitute --Novotny--.

under "Foreign Patent Documents" add the following to the list:

--4-141560 5/1992 Japan-- after the list of "Foreign Patent Documents" add the following:

--OTHER DOCUMENTS

Patent Abstracts of Japan, C-980, Sept, 2, 1992, vol. 16, No. 413--.

Column 1, line 63, delete "dO" and substitute --d0--.

* Column 6, line 46, delete "grater" and substitute --greater--;

line 62, delete "a" and substitute --as--.

In Table 2, in sub-heading "After treatment B", delete "Anit-rust" and substitute --Anti-rust--;

In Table 2-continued, in sub-heading "After treatment B", delete "Anit-rust" and substitute --Anti-rust--;

line 14, delete "105°C." and substitute --1050°C.--.

UNITED STATES PATENT AND TRADEMARK OFFICE

CERTIFICATE OF CORRECTION

PATENT NO. : 5,492,573

DATED : February 20, 1996

INVENTOR(S) : KATSUAKI FUKUSHIMA et al.

It is certified that error appears in the above-indentified patent and that said Letters Patent is hereby corrected as shown below:

* Column 11, line 21, delete "Brinnel" and substitute --Brinell-- line 42, delete "hardness,." and substitute --hardness.--.

line 44, delete "Brinnel" and substitute --Brinell--.

* Column 13, line 34, delete "an" and substitute --can--;

lines 35 and 36, delete "n" and substitute --in--.

UNITED STATES PATENT AND TRADEMARK OFFICE

CERTIFICATE OF CORRECTION

PATENT NO. :5,492,573

DATED :February 20, 1996

INVENTOR(S) :Katsuaki Fukushima, et al.

It is certified that error appears in the above-indentified patent and that said Letters Patent is hereby corrected as shown below:

Column 10, line 10:
In Table 2, in sub-heading "After treatment B", delete "Anit-rust" and substitute --Anti-rust--;

Column 12, line 1:
In Table 2-continued, in sub-heading "After treatment B", delete "Anit-rust" and substitute --Anti-rust--;
line 14, delete "105°C." and substitute --1050°C.--.

Signed and Sealed this

Eighth Day of October, 1996

*Attest:*

*Attesting Officer*

Bruce Lehman

BRUCE LEHMAN

*Commissioner of Patents and Trademarks*